United States Patent [19]

Hager

[11] 3,970,018

[45] July 20, 1976

[54] WORK FEEDING MECHANISM FOR SEWING MACHINES

[75] Inventor: Walter Hager, Kaigerslautern, Germany

[73] Assignee: Pfaff Industriemaschinen GmbH, Germany

[22] Filed: Aug. 27, 1975

[21] Appl. No.: 608,162

[30] Foreign Application Priority Data

Sept. 6, 1974 Germany ..... 7430111[U]

[52] U.S. Cl. ..... 112/206; 112/209

[51] Int. Cl.[2] ..... D05B 27/20

[58] Field of Search ..... 112/206, 203, 208, 209, 112/210, 212, 213, 214, 215

[56] References Cited

UNITED STATES PATENTS

| | | | |
|---|---|---|---|
| 1,685,436 | 9/1928 | Ringe | 112/206 |
| 3,198,154 | 8/1965 | Reeber | 112/210 |
| 3,285,210 | 11/1966 | Tretow et al. | 112/206 |
| 3,687,096 | 8/1972 | Smith | 112/206 |

*Primary Examiner*—H. Hampton Hunter
*Attorney, Agent, or Firm*—McGlew and Tuttle

[57] ABSTRACT

A sewing machine for sewing a material workpiece, comprises a needle holder having a sewing needle which is mounted for both pivotal movement for swinging backwardly and forwardly and vertical reciprocation. The needle is driven by a sewing machine main shaft which also drives first and second feed dogs which are independently cyclically and alternatively engageable with the material to be sewn for advancing it in timed relationship to the reciprocation and to the swinging movement of the needle.

7 Claims, 4 Drawing Figures

Fig. 2
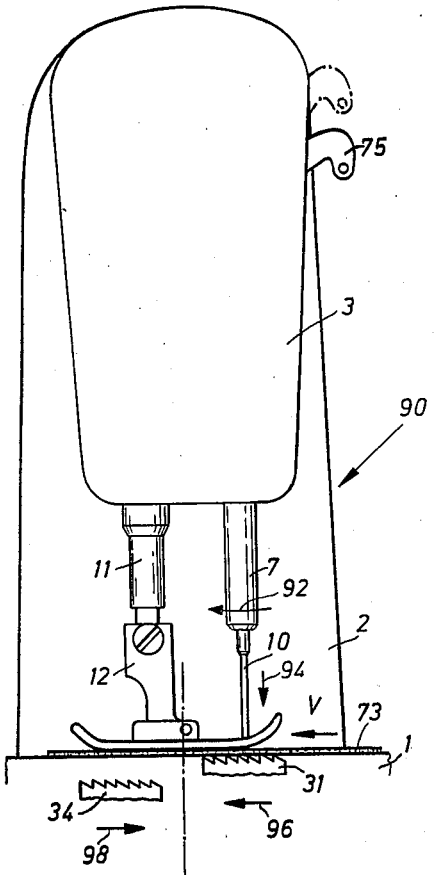
Fig. 3
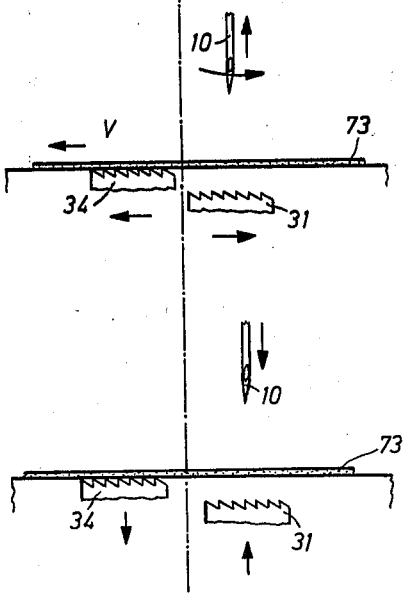
Fig. 4

WORK FEEDING MECHANISM FOR SEWING MACHINES

FIELD AND BACKGROUND OF THE INVENTION

The present invention relates to sewing machines and, in particular, to a new and useful sewing machine for sewing a material workpiece which comprises a needle holder having a sewing needle which is mounted for both pivotal movement for swinging backwardly and forwardly and for vertical reciprocation, and to a feed dog mechanism therefor.

DESCRIPTION OF THE PRIOR ART

In up-to-date heavy duty sewing machines, the so-called high speed sewing machines, which are medium sized, for example, 3.5 mm long, feed steps can be performed at the maximum speed of the intermittently driven feed dogs which move through a rectangular path in a sequence of motions. This is because with longer feed steps, the drive elements performing swing motions, and their bearings, would be exposed to excessive dynamic stresses and a too rapid wear resulting therefrom, and the entire sewing machine would be thrown into strong vibrations adversely affecting the handling of the work.

In normal cases, intermittently operating feed members execute their feed motion only during a part of the stitch-forming operation. Thus, for example, with a pure drop feed or four motion feed, the feed motion is effected while the needle is in a position outside the work whereas, with a combined drop feed and needle advance, the feed motion is effected while the needle is stuck in the work. If one could succeed in advancing the work in the feed direction as well during the period of time of a stitch-forming operation in which, up to now, the work stands still, the work would be advanced during each stitch-forming operation in two or more short feed steps adding to a single long advance. In such a case, the drive elements of the feed mechanism would perform relatively short stroke motions permitting a high speed operation of the sewing machine.

Sewing machines are known in which the work is moved by intermittently operating feed members during the entire stitch-forming operation. For example, a sewing machine equipped with an upper and a lower feed wheel is known in which, during a single stitch forming operation, each of the feed wheels executes two equal feed steps of which one is effected while the needle is stuck in the work and the other is effected while the needle is in a position outside the work. The desired effect of the immediate succession of the feed steps interrupted only by extremely short standstill periods is that the operator perceives the advance motion of the work as if it were a continuous motion and, therefore, becomes less rapidly fatigued than while checking a much more jerky feed caused by longer standstill periods. This known feed mechanism, however, is not suitable for high speed sewing machines, primarily treating textile fabrics, since in view of such material, disadvantages are connected to machines quite generally equipped with feed wheels. For example, the linear contact between feed wheel and material results in a high surface pressure capable of damaging thin and sensitive fabrics. Another disadvantage is that due to the particular design of the drive mechanism, neither a reversal of the feed direction nor a reduction of the feed steps can be effected during the run of the machine, so that consequently, the stitches can neither be locked nor made more dense in order to secure the end of the seam.

In another known sewing machine, a completely continuous feed is obtained. This, however, is a special sewing machine for the shoemaking industry, comprising a curved hook-type needle rotatably mounted above the work, a presser foot, a curved awl rotatably mounted beneath the work, and a work supporting table. These four parts of the machine execute a rectangular cycle of mutually dephased motions during which one or more of the elements always alternately act on the work and advance it during the entire stitch forming operation, at a constant speed.

As mentioned, this machine is a special device for the shoemaking industry and because of the use of an awl and a hook-type needle, it is basically unsuitable for treating textile fabric. In addition, the drive mechanism of the feed members which comprise cam plates and feeler rolls, long rocking levers and a reciprocating slider, carrying still other component parts, is also entirely unusable for high speed machines because the mentioned parts of the machine would be stressed beyond their rupture limits by the extremely high dynamic forces occurring at high speeds. Another drawback of this shoe sewing machine is that, for changing the feed advance, or the stitch length, during the standstill of the machine, no less than three rocking levers must be adjusted as to their effective lever length. Moreover, care must be taken that the lever lengths are adjusted exactly uniformly; since otherwise, either the awl or the needle would break, or the work would be damaged by the feed members executing irregular motions. Because of the complicated and time-consuming adjustment of the feed rate, this shoe sewing machine neither permits a locking of the seams nor a shortening of the stitch length and this is a further reason why this feed mechanism is absolutely unsuitable for high speed sewing machines for working textile fabrics.

SUMMARY OF THE INVENTION

The present invention permits the joining of textile fabric by long-stitch seams in sewing machines running at high speeds and, if desired, of securing the seams by locking the seam ends or condensing the stitches. For this purpose, the invention is directed to a feed mechanism comprising feed members acting on the work alternately during the entire stitch-forming operation and being adjustable, as to the direction and amount of their motion, by means of a common adjusting device.

In accordance with the invention, two feed dogs are provided, operating in a rectangular sequence of motions, in which one feed dog is positioned in the area of the motion path of the needle and its cycle of motion is adjusted to the advance motion of the needle, while the other feed dog is positioned in advance of the first feed dog in respect to the feed direction, and its cycle of motion is in phase opposition relative to the cycle of motion of the first feed dog.

During each stitch forming operation, the inventive feed mechanism advances the work by two feed steps in which the first step is executed conjointly by the first feed dog and the needle stuck in the work, while the second step is executed by the second feed dog, and during a period of time in which the needle is in a position outside the work, the first feed dog executes a rearwardly directed motion. If the new feed mechanism is used in a high speed sewing machine designed for a maximum permissible feed rate of the drive elements of, for example, 3.5 mm at the maximum speed, a total advance of the work of 7 mm is obtained at this maximum speed, which is extremely high as compared to normal high speed sewing machines. With normal stitch lengths, the two feed dogs execute short-stroke motions such that even at the maximum speed, a particularly smooth run of the drive elements of the feed mechanism is obtained. The smoothness of run is favored, in addition, by the fact that the motions of the feed dogs are in respective opposite directions whereby any dynamic forces which might have occurred are mutually compensated.

The drive mechanism for the two feed dogs may be designed in a manner similar to the known sewing machines equipped with a differential bottom feed and also provided with two feed dogs mounted one behind the other, however, with such a design, in the present case, the eccentrics for producing the respective rectangular motions must be adjusted in mutually dephased positions. Also, as in the known machines, the feed rates of the two feed dogs can be conjointly adjusted by means of a single stitch guide so that, for locking the seam or condensing the stitch, the feed direction can be reversed or the rate of the advance motion can be reduced.

Although the second feed step in each stitch forming operation is performed by only one feed member, namely the second feed dog, no disalignment occurs during the advance of two or more superposed fabric layers. That is, since the second dog is positioned in advance of the path of motion of the needle and, thereby, ahead of the stitch forming area of the sewing machine, it engages the work at a location where the fabric layers are already joined to each other by the previously formed stitches so that a mutual displacement of the fabric layers is not possible.

Due to the motion in phase opposition, thus with an angle of phase difference of the two feed dogs of substantially 180°, aside from the particularly uniform motion conditions, a further advantage is obtained in that, at the instant the take-up lever of the thread passes its top dead center, the second dog still accomplishes its advance motion. Thereby, an additional tensile force is exerted on the last-formed stitch which has already been tightened by the take-up lever, so that the thread in the stitch is definitely fastened. Also, in this case, the tensile force exerted by the take-up lever on the thread need not be so strong as if the lever acted alone. Consequently, the operation can be performed with a reduced needle thread tension whereby the thread is stressed less.

Accordingly, it is an object of the invention to provide an improved sewing machine for sewing material workpieces, which comprises a needle holder having a sewing needle which is mounted for swinging as well as reciprocal movement and which is operated in timed relationship to a pair of feed dogs which are moved alternately in opposite phase relationship and with one being engageable with the material during the penetration of the material by the needle and movable with the needle in the advance direction of feed during the time in which the other moves out of engagement with the material and to a return position for immediate engagement with the material as the first dog disengages the material.

A further object of the invention is to provide a sewing machine construction in which there is a simple control for varying the amplitude and direction of motion of two out of phase movement feed dogs in response to the reciprocation and swinging movement of a needle.

A further object of the invention is to provide a sewing machine and feeding mechanism therefor which are simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and descriptive matter in which there is illustrated a preferred embodiment of the invention.

BRIEF DESCRIPTION OF THE DRAWINGS

In the Drawings:

FIG. 2 is a simplified elevational view of the sewing machine in which the feed members are diagrammatically shown in their position at the beginning of the first feed step during a stitch forming operation;

FIG. 3 is a schematic front elevational view of the instantaneous positions of the feed members at the beginning of the second feed step; and FIG. 4 is a schematic front elevational view of the instantaneous positions of the feed members at the end of the second feed step.

DESCRIPTION OF THE PREFERRED EMBODIMENT

Figure 1:
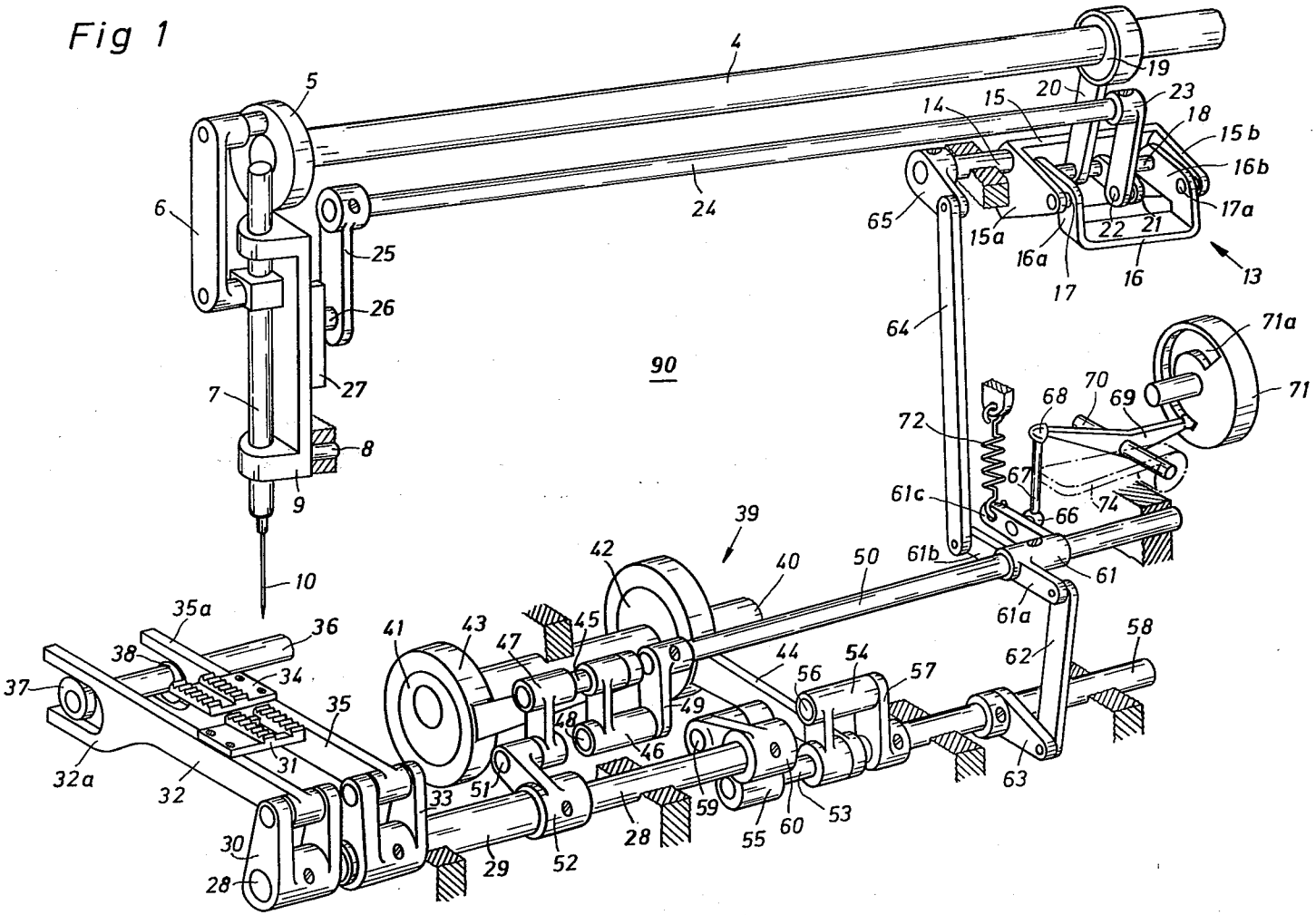
FIG. 1 is a perspective view of the feed mechanism of a sewing machine, also showing the drive means, constructed in accordance with the invention.

Referring to the drawings in particular, the invention embodied therein, comprises a sewing machine, generally designated 90, which, as is visible in FIG. 2, includes a bed plate 1 over which a material 73 to be worked upon is advanced along a sewing machine frame or support 2. Sewing machine frame 2 includes a head portion or casing 3 and a main shaft 4 is mounted within the casing for driving a needle bar 7 for both vertical reciprocation and swinging movement. The vertical reciproation of needle bar 7 is effected through a crank drive mechanism, including a crank 5 and a link 6. Needle bar 7 is also mounted for oscillation along with an oscillating arm 9 upon which it is mounted which swings about a pivot 8. Needle bar 7 carries a thread-guiding needle 10. A presser foot 12, as shown in FIG. 1, is secured to a presser bar 11.

In accordance with the invention, the sewing machine includes a feeding mechanism in the form of first and second feed dogs 31 and 34 which alternately and cyclically engage the workpiece 73 and advance it in the feed direction indicated by the arrow V. The first feed dog 31 engages the material 73 during a time at which the needle bar 7 and needle 10 are swung in the direction of the arrow 92. This is also effected during a time at which the needle 10 is moved downwardly in the direction of the arrow 94 to engage into material 73. During the advance movement of the feed dog 31 in the direction of the arrow 96, the second feed dog 34, which is out of phase with the first feed dog 31, moves out of engagement with material 73 in a return direction, in the direction of the arrow 98.

In accordance with the invention, the sewing machine comprises a mechanism, generally designated 13, for adjusting the swinging motion of the oscillating arm 9. The oscillating arm adjusting mechanism 13 includes an adjusting shaft 14 to which a bracket 15 is secured. Between arms 15*a* and 15*b* of bracket 15, a further bracket 16 is mounted for rotation by means of pins 17 and 17*a*. Arms 16*a* and 16*b* of bracket 16 are connected to each other by a pin 18 to which swinging motion about pins 17, 17*a* is imparted by an eccentric 19 secured to main shaft 4, through an eccentric arm 20. Pin 18 further carries a link 21 which is pivoted by means of a pin 22 to a crank 23 which is secured to one end of an oscillating shaft 24 extending in parallel to main shaft 4. The other end of oscillating shaft 24 is connected to a crank 25 carrying a pin 26 which is guided between two flanges 27 provided on the back side of oscillating arm 9.

In bed plate 1, two coaxial shafts 28 and 29 extending parallel to main shaft 4 are mounted, the inner shaft 28 projecting at both ends beyond the outer shaft 29. A clevis 30 is secured to inner shaft 28 and a feed dog bar 32 carrying a first feed dog 31 is pivoted on the clevis. To outer shaft 29, clevis 33 is secured, to which a feed dog bar 35 carrying the second feed dog 34 is pivoted. Each of the feed dog bars 32, 35 has a forked end portion 32*a*, 35*a*, respectively, receiving a lifting eccentric 37, 38 secured to a shaft 36. At the rotation of shaft 36, eccentrics 37, 38 impart the lifting motions necessary for producing the rectangular motion cycle to feed dogs 31, 34. As may be seen in the drawing, the two eccentrics 37, 38 are mounted in phase opposition, wherefore, the vertical motions of the two feed dog bars 32, 35 and, consequently, of the two feed dogs 31, 34, are opposite to each other.

A feed dog control mechanism for producing and adjusting the horizontal advance motions of the two feed dogs 31, 34 is generally designated 39. A shaft 40 which is parallel to shafts 28, 29, is mounted in bed plate 1 and receives its motion from main shaft 4, through a drive belt (not shown). Two push eccentrics 41, 42 are secured to shaft 40, each of which is embraced by an eccentric arm 43, 44, respectively. As shown in the drawing, the two push eccentrics 41, 42 are also mounted in phase opposition so that the two eccentric arms 43, 44 execute opposite motions.

Two links 54 and 55 are pivoted to eccentric arm 44 by means of a pin 53. Link 54 is rotatably connected, by means of a pin 56, to a crank 57 which is secured to an adjusting shaft 58. By means of a pin 59, link 55 is pivoted to a crank 60 which is secured to the inner shaft 28. Cranks 49, 57 and 52, 60, as well as links 46, 47 and 54, 55 have the same effective lengths.

Two links 46 and 47 are pivoted to eccentric arm 43 by means of a pin 45. Link 46 is rotatably connected, by means of a pin 48, to a crank 49 which is secured to an adjusting shaft 50. Link 47 is pivoted, by means of a pin 51, to a crank 52 which is secured to the outer shaft 29.

A three-arm feed dog and needle swing adjustment crank 61 for a simultaneous adjustment of all of the three adjusting shafts 14, 50 and 58, is secured to adjusting shaft 50. Crank 61 has one arm 61*a* connected, through a link 62, to a crank 63 which is secured to adjusting shaft 58 while another arm 61*b* of crank 61 is connected, through a link 64, to a crank 65 which is secured to adjusting shaft 14. Against a third arm 61*c* of crank 61, a link 67 is applied through a ball-and-socket joint 66 which, through a further ball-and-socket joint 68, is operatively connected to a two-armed lever 69. The other arm of lever 69, which is secured to a shaft 70 mounted in support 2, engages into a groove 71*a* of an adjusting disc 71 which is also rotatably mounted on support 2. A tension spring 72 applies against arm 61*c* at its one end and, at its other end, it is attached to the casing of the sewing machine. The end portion of lever 69 engaging groove 71*a* is biased by spring 72 against the exterior wall of groove 71*a*, and the feed dogs 31, 34, in connection with needle 10, feed the work 73 in the advance direction. For reversing the feed direction, a switch lever 74 is secured to the end of shaft 70 projecting from support 2, by which lever 69 can be pivoted so as to apply against the interior wall of groove 71*a*.

The feed mechanism operates as follows:

In FIG. 1, adjusting disc 71 is adjusted to the stitch length zero. In this position, the axes of pins 48, 51, of pins 56, 59, and of pins 17, 17*a*, 22 are aligned so that links 47, 55 and 21 execute pure rotary motions about the respective pins 51, 59 and 22 while cranks 52, 60 and 23 stand still. Since, consequently, shafts 28, 29 and oscillating shaft 24 also stand still, feed dogs 31, 34 and needle 10 do not execute any feed motion.

For adjusting a feed rate, as soon as adjusting disc 71 is turned out of its zero position, adjusting shaft 50 is turned also through lever 69, link 67 and three-arm crank 61. While turning, adjusting shaft 50 takes crank 49 along, thereby displacing pin 48 serving as axis of rotation for link 46 off alignment with pin 51 which serves as axis of rotation for link 47. In consequence, during the pivotal motion of pin 45 caused by eccentric arm 43, link 46 executes a pure rotary motion about pin 48 while link 47, aside from a rotary motion about pin 51, executes a relative motion about shaft 29 in addition. This relative motion is transmitted by crank 52 as a pivotal motion to clevis 33 which, through feed dog bar 35, imparts advance motions to second feed dog 34.

The turning of adjusting shaft 50 has the effect that, through crank arm 61*a*, link 62 and crank 63, adjusting shaft 58 is simultaneously turned through the same angle. Due to this motion, link 54 is pivoted by crank 57 which is secured to shaft 58, so that pin 56 is displaced off alignment with pin 59. Consequently, during the pivotal motion of pin 53 caused by eccentric arm 44, link 54 executes a pure rotary motion about pin 56 while link 55, in the same manner as mentioned above in connection with link 47, aside from a rotary motion about pin 59, executes a relative motion about shaft 28, in addition. This relative motion is transmitted, by crank 60, as a pivotal motion to clevis 30 which, through feed dog bar 32, imparts advance motions to first feed dog 31 which are exactly equal to the advance motions of second feed dog 34. In addition, the turning of adjusting shaft 50 has the effect that, through crank arm 61*b*, link 64 and crank 65, adjusting shaft 14 is simultaneously turned through the same angle. During this motion, bracket 16 is pivoted by bracket 15 which is secured to shaft 14, so that pins 17, 17*a* serving as axis of rotation for bracket 16 are displaced off alignment with pin 22. Consequently, during the pivotal motion of pin 18 caused by eccentric arm 20, bracket 16 executes a pure rotary motion about pins 17, 17*a* while link 21, analogously to links 47 and 55, in addition to a rotary motion about pin 22, executes a relative motion about oscillating shaft 24. This oscillating motion is transmitted, through crank 25 and pin 26, to oscillating arm 9 which, in consequence, executes oscillating motions in the feed direction about pivot 8.

As already mentioned, both the lifting eccentrics 37, 38 and the push eccentrics 41, 42 are mounted in phase opposition so that the two feed dogs 31, 34 execute mutually opposite motions in the vertical and horizontal directions. These motions are adjusted to the oscillatory motion of needle 10 in a manner such that during a stitch-forming operation, the first feed dog 31 along with needle 10 executes a first feed step and, subsequently, the second feed dog 34 executes a second feed step. The instantaneous positions and motion directions of these three feed members (10, 31, 34) in different phases of a stitch-forming operation are diagrammatically shown in FIGS. 2 to 4 with the aid of direction arrows.

FIG. 2 shows the instantaneous motion conditions at the beginning of the first feed step. The needle 10 stuck into the workpiece 73 and the first feed dog 31 applying from below against the workpiece 73, move in the feed direction V while the lowered second feed dog 34 executes a rearwardly directed motion. FIG. 3 shows the instantaneous motion conditions at the beginning of the second feed step. At this instant, second feed dog 34 is lifted and executes a feed motion alone, while needle 10 is in a position outside the workpiece 73 and moves upwardly and executes, along with the lowered first feed dog 31, a rearwardly directed motion opposite to the feed direction V. FIG. 4 shows the instantaneous motion conditions at the end of the second feed step. The second feed dog 34 having reached the end point of its advance motion is going to be lowered while the first feed dog 31 having reached the end point of its return motion is going to be lifted. At the same time, needle 10 approaches the workpiece 73 again.

In this manner, workpiece 73 is advanced by two feed steps during each stitch forming operation, which steps add to a large total advance resulting in a long stitch. Since, at the same time, feed members 10, 31, 34 travel along relatively short distances, the sewing machine can run at the maximum speed, for example, at 6,000 rpm of main shaft 4, and produce seams having 7 mm long stitches. For securing the thread at the end of the seam, the feed direction of the feed members 10, 31, 34 can be reversed during the run of the sewing machine by actuating switch lever 74.

Due to the phase opposition between lifting eccentrics 37, 38 and push eccentrics 41, 42, the drive elements actuated by these eccentrics and, at the end of the train, also the two feed dogs 31, 34, execute mutually opposite motions. As a result of these motion conditions, the dynamic forces produced by the oscillating drive elements and the feed dogs 31, 34 act against one another, thus are mutually compensated and, with substantially no vibrations, the run of the sewing machine becomes particularly smooth.

Further, again due to the operation in phase opposition of the two feed dogs 31, 34, a motional sequence is obtained in that the second feed dog 34 still accomplishes the last part of its advance motion while the take-up lever 75 for the thread has already passed its top dead center. In this way, the second feed dog 34 exerts an additional tensile force on the last formed stitch which has been lever by the take-up lover 75, whereby, the thread in this stitch is definitely fastened. In consequence, take-up lever 75 does not need to exert as strong a tensile force on the thread as it would if it was necessary for it to tighten the thread alone, and the operation can be effected with a reduced tension of the needle thread and, therefore, with a thread which is stressed less.

The inventive idea underlying the described embodiment can be applied in the same effective manner as well to a sewing machine which, in addition to the feed mechanism disclosed, comprises a top feed dog. In such a case, the first feed step in each stitch forming operation would be performed by the first feed dog along with the needle and the top feed dog, while the second feed step, as before, would be performed by the second feed dog alone.

While a specific embodiment of the invention has been shown and described in detail to illustrate the application of the principles of the invention, it will be understood that the invention may be embodied otherwise without departing from such principles.

What is claimed is:

1. A sewing machine for sewing a material workpiece, comprising a needle holder having a sewing needle, means mounting said needle holder for pivotal movement to swing said holder with said needle backwardly and forwardly, a rotatable sewing machine main shaft, means connected between said main shaft and said needle holder to reciprocate said holder with said needle to periodically engage and disengage the workpiece, first and second feed dogs cyclically engageable with the material to be sewn for advancing it in timed relationship to the reciprocation and swinging movement of said needle, means connected to said first and second feed dogs and said sewing machine main shaft to move said first feed dog into engagement with the workpiece during the downward reciprocation of the needle into engagement with the workpiece and to advance it in a feed direction to the final feed position while said needle is swinging in the feed direction and while the second feed dog is moved out of phase with said first feed dog out of engagement with the material from the final feed position and returned to a feed starting position and subsequently engages the material after its release by the first feed dog and the needle from the final feed position during the return of the first feed dog to the starting position.

2. A sewing machine for sewing a material workpiece, according to claim 1, including first and second arms, first and second feed dog shafts separately connected to said first and second arms for shifting said arms backwardly and forwardly and first and second lifting eccentrics engageable with respective first and second arms for periodically raising and lowering said arms, said first and second eccentrics being arranged so that they are 180° out of phase with each other.

3. A sewing machine for sewing a material workpiece, according to claim 2, including first and second adjusting shafts connected to said first and second feed dog shafts and means connected to said first and second adjusting shafts for adjusting said shafts to vary the direction and speed of movement of said feed dogs.

4. A sewing machine for sewing a material workpiece, according to claim 3, including a swing motion adjustment mechanism for adjusting the swinging motion of said needle, said adjusting means connected to said first and second adjusting shafts being connected to said swing arm adjusting means to adjust the swinging movement of said needle.

5. A sewing machine for sewing a material workpiece, according to claim 2, including an adjusting disc connected to one of said adjusting shafts, said disc being rotatable to adjust the direction and speed of movement of said feed dogs, and a crank arm connected to said first and second feed dog shafts to adjust the oscillatory movement thereof.

6. A sewing machine for sewing a material workpiece, according to claim 1, including means for adjusting the amplitude of swinging movement of said needle holder and said needle.

7. A sewing machine for sewing a material workpiece, according to claim 1, including an inner first feed dog shaft connected to said first feed dog to move said first feed dog backwardly and forwardly, a second outer shaft arranged concentrically in respect to said inner first shaft and connected to said second feed dog for moving said second feed dog backwardly and forwardly, and first and second eccentric cam means rotatably mounted adjacent said first and second feed dogs for periodically raising and lowering said feed dogs during their backward and forward movement, said first and second eccentric cam means acting on said feed dog arms out of phase from one another.

* * * * *